US005122066A

United States Patent [19]

Plossmer

[11] Patent Number: 5,122,066

[45] Date of Patent: Jun. 16, 1992

[54] ELECTRICAL TERMINAL WITH MEANS TO INSURE THAT A POSITIVE ELECTRICAL CONNECTION IS EFFECTED

[75] Inventor: Hartmuth G. F. Plossmer, Lautertal, Fed. Rep. of Germany

[73] Assignee: AMP Incorporated, Harrisburg, Pa.

[21] Appl. No.: 727,767

[22] Filed: Jul. 10, 1991

[30] Foreign Application Priority Data

Jul. 27, 1990 [GB] United Kingdom ..... 9016529

[51] Int. Cl.[5] ..... H01R 9/09

[52] U.S. Cl. ..... 439/78; 439/81; 439/883

[58] Field of Search ..... 439/78–83, 439/860, 873, 876, 883, 888

[56] References Cited

U.S. PATENT DOCUMENTS 4,895,521 1/1990 Grabbe ..... 349/78

4,898,539 2/1990 Glover et al. ..... 439/81

4,998,887 3/1991 Kaufman et al. ..... 439/78

*Primary Examiner*—Paula A. Bradley

*Attorney, Agent, or Firm*—Bruce J. Wolstoncroft

[57] ABSTRACT

An electrical terminal (2) for making an electrical connection between an electrical device and a printed circuit board (18). The terminal (2) has a resilient section (6) which is provided between a contact receiving section (8) and a mounting section (4). The resilient section (6) can compensate for misalignment and board warpage. The contact receiving section (8) has a pair of resilient legs (70, 72) which are positioned on either side of an opening (60), thereby allowing the opening to compensate for misalignment of a mating connector (94). The resilient legs (70, 72) also allow for numerous insertions and withdrawals of the mating connector (94).

10 Claims, 3 Drawing Sheets

ELECTRICAL TERMINAL WITH MEANS TO INSURE THAT A POSITIVE ELECTRICAL CONNECTION IS EFFECTED

FIELD OF THE INVENTION

The invention is directed to an electrical terminal which electrically interconnects a first electrical component to a second electrical component. The electrical terminal has a resilient section which allows the terminal to compensate for the dimensional tolerances of the housing into which the terminal is inserted, thereby insuring that the electrical terminal will make a positive electrical connection with the first and the second components.

BACKGROUND OF THE INVENTION

There are various known connectors which electrically connect an electrical device, such as a motor, to a printed circuit board. Many of these connectors require precise alignment of the various components, as the terminals have no means to compensate for the misalignment of openings or the warpage of the printed circuit board. Consequently, the connectors and boards must be manufactured with controlled tolerance limits. In order to control the tolerance limits, the connectors must be manufactured under precise conditions, which generally adds to the cost of the connector.

In order to repair or replace many of the prior art connectors, the entire electrical device and the connector with the terminals positioned therein have to be replaced. This leads to difficulties and increased expense. In particular, if the electrical device must be replaced in the field, there is a possibility that the replacement will not be adequately installed, thereby causing the electrical device to malfunction.

It would therefore be beneficial to provide a connector for use with an electrical device and a printed circuit board which had the means to compensate for misalignment and board warpage. It would also be of benefit if the connector was configured to allow for the easy removal and replacement of the electrical device.

SUMMARY OF THE INVENTION

The invention is directed to an electrical terminal which insures that a positive electrical connection will be effected between a first electrical component and a second electrical component. The electrical terminal has a mounting section and a contact receiving section. A resilient section is provided between the mounting sections and the contact receiving section, whereby the resilient section will compensate for any dimensional variations between the mounting section and the contact receiving section caused by environmental conditions.

The contact receiving section of the electrical terminal is in the form of a tab portion which extends from the resilient section in an opposed direction to the mounting section, the tab portion has an opening which extends therethrough for receipt of a mating electrical connector therein. Slots extend from the opening in essentially opposed relation to each other, the slots extend through the tab to form resilient legs on either side of the opening, thereby allowing the opening to compensate for the various mating electrical connectors provided therein. The configuration of the contact receiving section also allows for numerous insertions and removals of the mating electrical connectors.

DETAILED DESCRIPTION OF THE INVENTION

Figure 1:
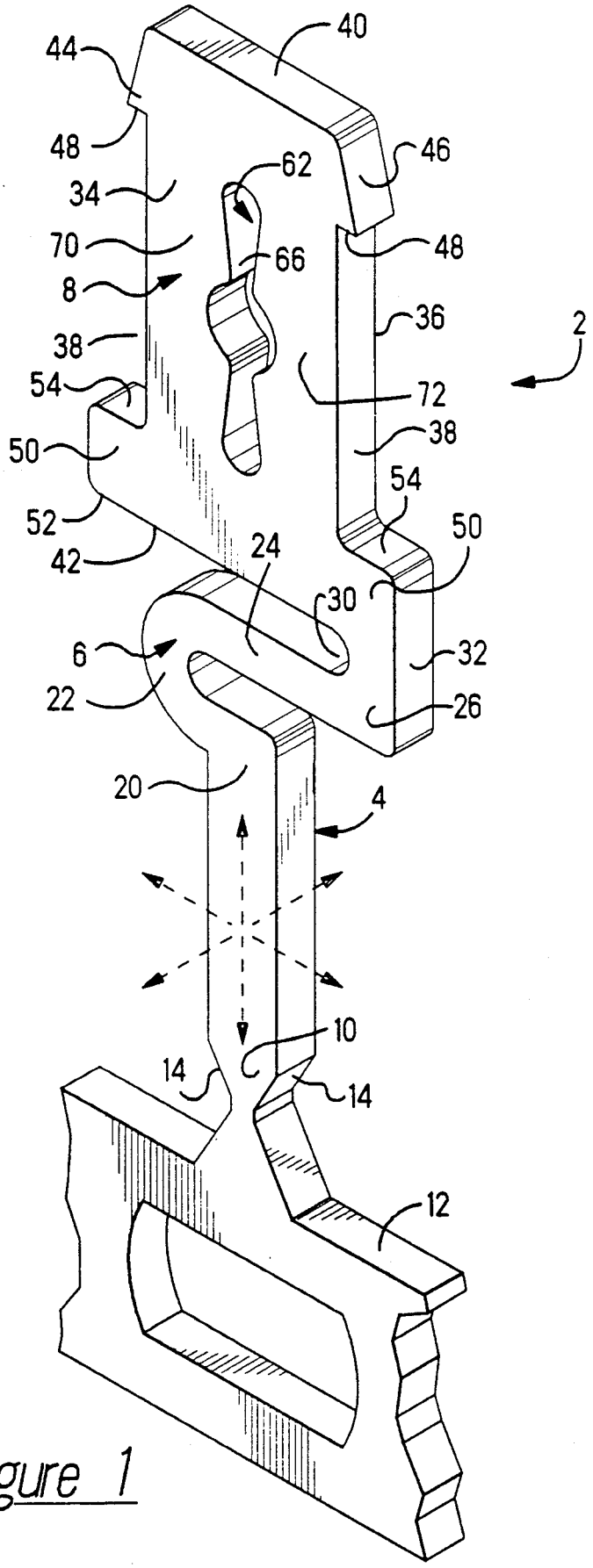
FIG. 1 is a perspective view of an electrical terminal according to the present invention, the arrows are provided to indicate the direction in which a portion of the terminal can move.

As shown in FIG. 1, an electrical terminal 2 has a mounting portion 4, a resilient portion 6, and an engagement or contact receiving portion 8. These portions cooperate to allow the terminal 2 to compensate for any warpage or misalignment, as represented by the arrows in FIG. 1. This will be more fully discussed below. The terminal is stamped from material having the electrical and mechanical characteristics required.

Figure 3:
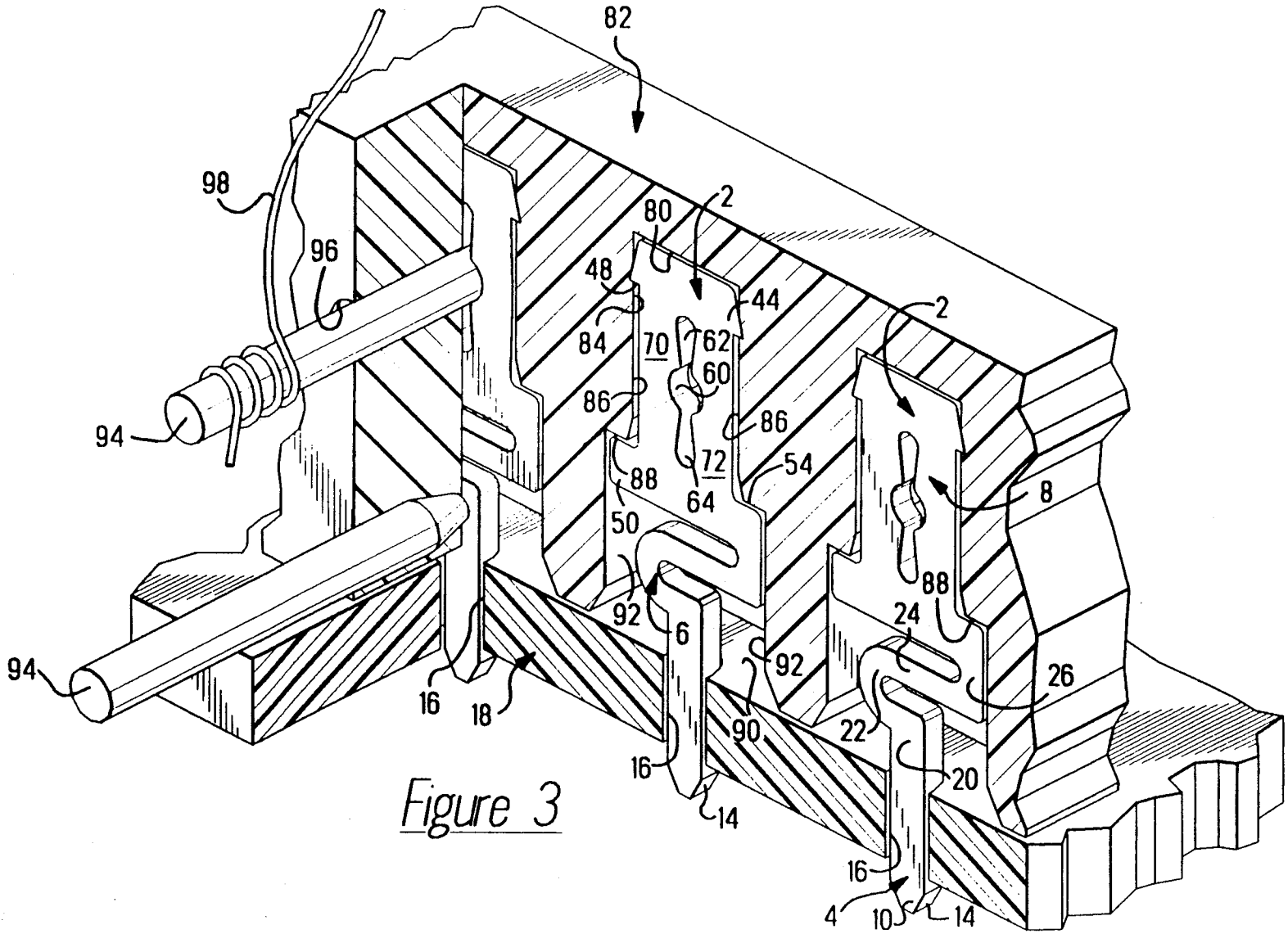
FIG. 3 is a perspective view of a series of terminals, each terminal is shown at a different stage of termination.

The mounting portion 4 has an end 10 which is initially attached to a carrier strip 12. The carrier strip 12 is a continuous strip of material which has a plurality of terminals 2 which extend therefrom. End 10 has sloping surfaces 14 which extend from side surfaces 16 to end 10. The sloping surfaces 14 are lead-in surfaces, which insure that the mounting portion 4 will be properly inserted into a respective opening 16 of printed circuit board 18, as shown in FIG. 3.

Figure 2:
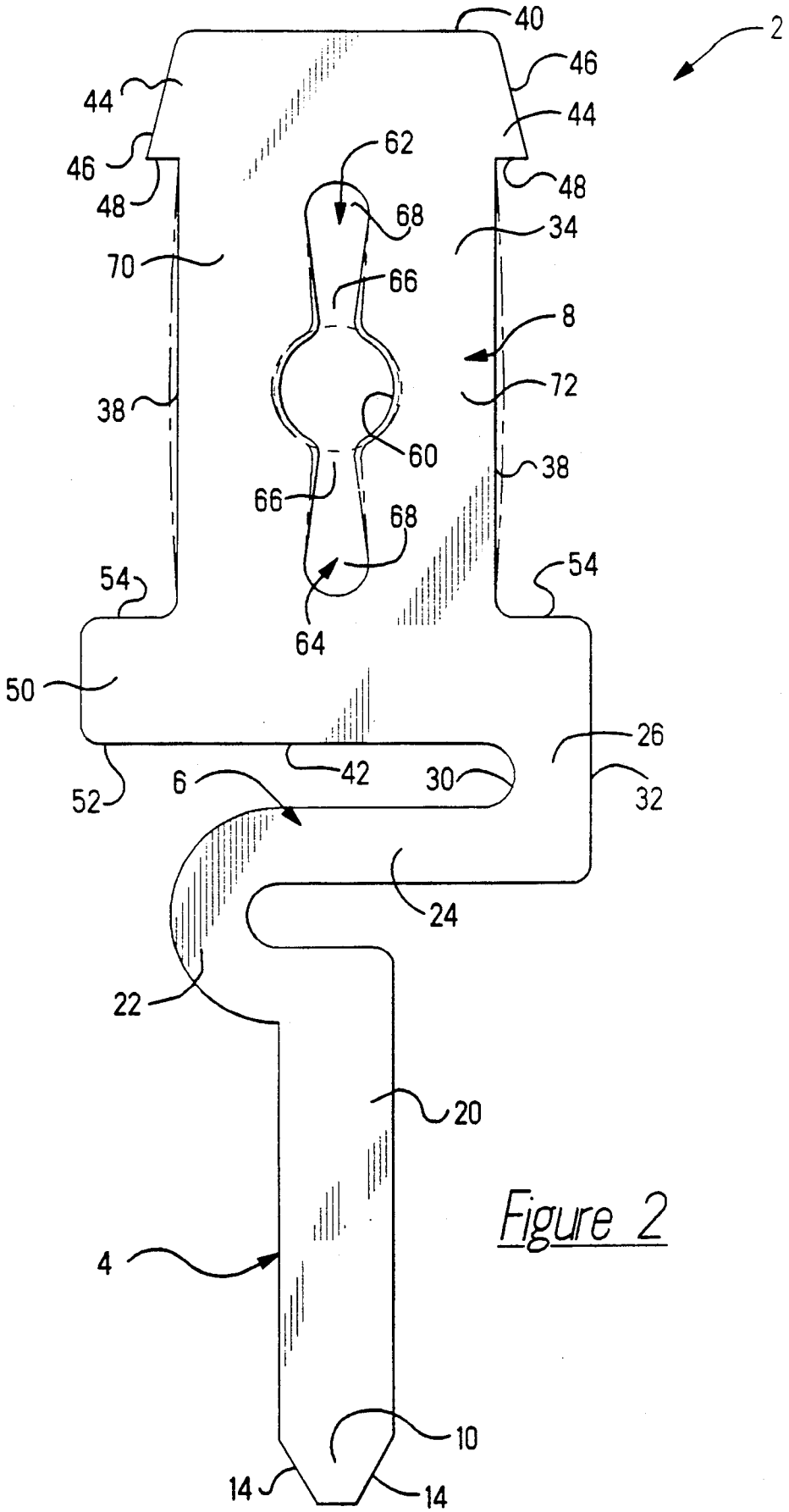
FIG. 2 is a front view of the terminal, illustrating the movement of the resilient legs.

Extending from end 20 of mounting portion 4 is resilient portion 6. As best shown in FIGS. 1 and 2, resilient portion 6 has a curved section 22, a straight section 24 which extends from the curved section 22 and an end section 26 which extends from the straight section 24. The curved section 22 has a generally C-shaped configuration, with one end of the curved section 22 integrally attached to mounting portion 4 and the other end of the curved section 22 integrally attached to straight section 24. The straight section 24 has a longitudinal axis which extends in a direction which is essentially perpendicular to the longitudinal axis of the mounting portion 4.

Integrally attached to the straight section 24, at an end of the straight section which is not attached to the curved section, is the end section 26. The end section 26 extends in a direction which is essentially perpendicular to the direction of the straight section 24. As best shown in FIGS. 1 and 2, the end section 26 has a curved inner side surface 30 and a relatively straight outer side surface 32. End section 26 is integrally attached to engagement portion 8.

It is worth noting that the resilient characteristics of the resilient portion 6 are dependent on several factors. First, the resiliency depends on the particular material used. Section, the dimensioning of the various sections effects the resilient characteristics of the resilient portion. Consequently, changes in lengths and widths of the sections can change the resilient characteristics of the terminal 2.

Engagement portion 8 has a first major surface 34 and an oppositely facing second major surface 36. Side surfaces 38, top end surface 40, and bottom end surface 42 extend between the first and second major surfaces. Bottom end surface 42 and top end surface 40 extend in a direction which is essentially parallel to the plane of the longitudinal axis of the straight section 24.

Provided on each side surface 38, proximate the top end surface 40 is a barb 44. Each barb 44 has a sloping surface 46 which extends from the top end surface to a shoulder 48. The shoulder cooperates with a housing, as will be more fully described.

Projections 50 also extend from side surfaces 38. The projections 50 are positioned proximate bottom end surface 42. In the embodiment shown in the figures, the bottom edges 52 of the projections 50 are coplanar with the bottom end surface 42. A respective bottom edge has the engagement portion 8 integrally attached thereto. Top edges 54 of projections 50 are provided to cooperate with the housing.

An opening 60 extends through engagement portion 8, from the first major surface 34 through the second major surface 36. A pair of channels 62,64 are provided in engagement portion 8, and extend from the top and the bottom of the opening 60 toward respective end surfaces 40,42. As best shown in FIG. 2, the channels 62,64 have a narrow section 66 provided proximate the opening 60, and a wide section 68 provided away from the opening 60. In the embodiment shown, the channel 62 and the channel 64 are essentially identical, with the channel 64 being a mirror image of the channel 62. Each channel 62,64 extends from the first major surface 34 through the second major surface 36.

The configuration of the opening 60 and the channels 62,64 essentially splits the engagement portion 8 into two resilient legs 70,72 which are joined at either end thereof. This configuration allows the legs 70,72 to flex outward from the longitudinal axis of the engagement portion, as best shown by the lines drawn in phantom in FIG. 2.

Referring to FIG. 3, a plurality of terminals 2 are inserted into respective cavities 80 of housing 82. In order to mass insert the terminals into the cavities 80, the terminals 2 are retained on the carrier strip 12 in the manner shown in FIG. 1. In order to assemble the terminals into the housing 82, the carrier strip 12 is cut to the appropriate length, such that the number of terminals provided on the cut portion of the carrier strip is equal to the number of cavities 80 provided in the housing 82. The carrier strip and terminals are then moved into a position in which the terminals are positioned just below the housing, and in alignment with the recesses.

With the terminals properly positioned, a force is applied to either the housing or the carrier strip, to move the housing and carrier strip into cooperation. This causes the terminals to move relative to the housing 82. As this movement occurs the engagement portions 8 are forced into narrow portions 84 of cavities 82. The dimensions of the narrow portions 84 are such that as the engagement portions 8 are forced therein, the barbs 44 engage side walls 86 of the narrow portions 84. As the width of the narrow portions is less than the width of the engagement portions 8, as measured between the end points of the barbs, the barbs 44 will frictionally engage and distort the side walls 86 of the cavities 80. This continues until the terminals 2 are moved to the fully inserted position, as shown in FIG. 3. In this position, the shoulders 48 cooperate with the side walls 86 to prevent the inadvertent removal of the terminals 2 from the cavities 80. In other words, the shoulders 48 of the barbs 44 engage the distorted side walls 86 of the cavities 80, thereby insuring that the terminals will not back out of the cavities.

The terminals 2 are fully inserted into the cavities when the top edges 54 are placed in engagement with shoulders 88 of cavities 80. The cooperation of the edges 54 and shoulders 88 prevents the terminals from being further inserted.

In this fully inserted position, the resilient sections 6 are positioned in the wide portions 90 of cavities 80. The stability of the terminals is insured, as the projections 50 cooperate with side walls 92 and the barbs 44 cooperate with the side walls 86 to prevent the movement of the engagement portions 6 relative to the housing 82.

With the terminals 2 fully inserted into the cavities 80, the carrier strip 12 is removed. The printed circuit board 18 is then moved into position. The openings 16 are aligned with the mounting portions 4, and the circuit board and housing are moved together.

The mating of the housing and printed circuit board is facilitated by the resilient portions 6 of the terminals 2. As the housing is mated to the circuit board, it is conceivable that the respective mating portions 4 and openings 16 in the circuit board will not be in precise alignment. This is due to the tolerances associated with molding, etc. Consequently, it is important that the terminals have a means to compensate for misalignment. This is particularly important if the connector must be replaced in the field, which usually requires blind mating.

The configuration of the resilient portions 6 allow the mating portions 4 to compensate for misalignment. Referring to FIG. 1, the resilient portions 6 have resilient characteristics in the directions indicated by the arrows. As the mounting portions 4 are integrally attached to the resilient portions 6, each mounting portion 4 is able to move if the respective opening 16 is slightly misaligned with the mounting portion. This helps to insure for a positive electrical connection between the terminal 2 and the circuit board 18.

As viewed in FIG. 1, the resilient portions 6 are also able to move in a direction as indicated by the up and down arrows. This is an important feature, particularly when the housing 82 is mated with a large printed circuit board. In many instances, printed circuit boards have warpage associated therewith. Consequently, it is important for the terminals to be able to compensate for any irregularities of the board. The configuration of the resilient portions 6 provide for this type of compensation, thereby insuring for a positive electrical connection.

Once the printed circuit board 18 is properly positioned, mating pins 94 are inserted into openings 60 of the engagement portions 8, as shown in FIG. 3. It should be noted that FIG. 3 illustrates the sequence of the insertion of the pin into the terminal, consequently only the pin 94 on the far left of the drawing is fully inserted into the opening.

Each pin 94 is inserted into an opening 96 of the housing 82. Each engagement portion 8 is positioned in the cavity 80 such that opening 60 is aligned with opening 96. Therefore, as the pins 94 are forced into the housing, the ends of the pins will be forced into openings 60. The diameters of the pins are slightly larger than the diameters of the openings, so that as the pins are inserted, the openings 60 will be forced to deflect, as shown in FIG. 2. As the openings are deflected, the resilient legs 70,72 are forced to deflect outward. However, the resilient nature of the legs insures that the legs will be maintained in electrical engagement with the pins.

It is important to note, that although the engagement portions 8 are retained in the cavities 80, the resilient legs 70,72 are not provided in engagement with the side walls 86. Instead, a gap is provided between the side walls 86 and the legs 70,72, thereby providing the legs with the space required for their resilient movement.

The resilient legs also provide a means to compensate for the misalignment of the pins. If a respective pin is slightly offset from an opening 60, the resilient legs 70,72 will bend accordingly to accept the pin therein and insure that a positive electrical connection is effected between the pin and the terminal.

With the pins 94 fully inserted into the openings 96 of the housing 82 and the openings 60 of the terminals 2, wires 98 are wrapped around the pins 94. The wires extend to a motor or some other type of electrical device (not shown). Consequently, an electrical pathway is established from the electrical device to the printed circuit board.

An advantage of the invention relates to the resiliency of the terminal. As the terminal can compensate for misalignment and board warpage, a positive electrical connection is essentially insured. Also, the interface between the terminal and the pin is such that the pin can be removed and replaced many times without damaging the terminal. This makes for an easy and convenient repair and replacement of the electrical device.

While the form of the connector herein described constitutes a preferred embodiment of this invention, it is to be understood that the invention is not limited to this precise form of connector, and the changes may be made without departing from the scope of the invention which is defined in the appended claims.

I claim:

1. An electrical terminal comprising:

a mounting section and a contact receiving section;

a resilient section, the resilient section provided between the mounting sections and the contact receiving section;

the contact receiving section is a tab portion which extends from the resilient section in an opposed direction to the mounting section, the tab portion has an opening which extends therethrough for receipt of a mating electrical connector therein;

whereby the resilient section will compensate for any dimensional variations between the mounting section and the contact receiving section caused by environmental conditions.

2. An electrical terminal as recited in claim 1 wherein slots extend from the opening in essentially opposed relation to each other, the slots extend through the tab portion to form resilient legs on either side of the opening, thereby allowing the opening to compensate for the various mating electrical connectors provided therein.

3. An electrical terminal as recited in claim 2 wherein the opening and the slots extend along the longitudinal axis of the tab portion, the opening and the slots dividing the tab portion into two essentially equal resilient legs which are joined at the ends thereof.

4. An electrical terminal as recited in claim 2 wherein the resilient section extends from a first end surface of the tab portion, the resilient section has a substantially S-shaped configuration which provides the resilient section with the resilient characteristics required to allow the contact receiving section to move relative to the mounting section.

5. An electrical terminal as recited in claim 2 wherein alignment and retention projections are provided proximate a second end surface of the tab portion.

6. An electrical terminal as recited in claim 5 wherein stop surfaces are provided on the tab portion proximate the first end surface thereof.

7. An electrical terminal comprising:

a mounting section and a contact receiving section;

a resilient section, the resilient section provided between the mounting section and the contact receiving section;

the contact receiving section is a tab portion which extends from the resilient section in an opposed direction to the mounting section;

whereby the resilient section will compensate for any dimensional variations between the mounting section and the contact receiving section caused by environmental conditions.

8. An electrical terminal as recited in claim 7 wherein the resilient section extends from a first end surface of the tab portion, the resilient section has a substantially S-shaped configuration which provides the resilient section with the resilient characteristics required to allow the contact receiving section to move relative to the mounting section.

9. An electrical terminal as recited in claim 7 wherein slots extend from an opening in the tab in essentially opposed relation to each other, the slots extend through the tab portion to form resilient legs on either side of the opening, thereby allowing the opening to compensate for the various mating electrical connectors provided therein.

10. An electrical terminal as recited in claim 9 wherein the opening and the slots extend along the longitudinal axis of the tab portion, the opening and the slots dividing the tab portion into two essentially equal resilient legs which are joined at the ends thereof.

* * * * *

UNITED STATES PATENT AND TRADEMARK OFFICE

CERTIFICATE OF CORRECTION

PATENT NO. : 5,122,066

DATED : June 16, 1992

INVENTOR(S) : Hartmuth G.F. Plosser

It is certified that error appears in the above-indentified patent and that said Letters Patent is hereby corrected as shown below:

On the title page: Item [75] change the inventor's name from "Plossmer" to --Plosser --.

Signed and Sealed this

Twenty-eighth Day of December, 1993

*Attest:*

BRUCE LEHMAN

*Attesting Officer*

*Commissioner of Patents and Trademarks*